US012479687B1

(12) United States Patent
Gondek et al.

(10) Patent No.: US 12,479,687 B1
(45) Date of Patent: Nov. 25, 2025

(54) MULTI-POSITION TAPE DISPENSER

(71) Applicants: Mark M. Gondek, Milwaukee, WI (US); Joe P. Muenkel, Milwaukee, WI (US)

(72) Inventors: Mark M. Gondek, Milwaukee, WI (US); Joe P. Muenkel, Milwaukee, WI (US)

(73) Assignee: IPPD, LLC, Milwaukee, WI (US)

( * ) Notice: Subject to any disclaimer, the term of this patent is extended or adjusted under 35 U.S.C. 154(b) by 210 days.

(21) Appl. No.: 18/388,350

(22) Filed: Nov. 9, 2023

(51) Int. Cl.
*B65H 35/00* (2006.01)

(52) U.S. Cl.
CPC ..... *B65H 35/0073* (2013.01); *B65H 2405/45* (2013.01)

(58) Field of Classification Search
CPC ..... A47K 10/38; A47K 10/40; B65H 16/08; B65H 18/021; B65H 18/0212; B65H 49/32; B65H 75/02; B65H 75/18; B65H 35/0073; B65H 35/002; B65H 2405/45; B65H 2701/37
USPC ... 242/594, 594.3, 594.4, 594.5, 594.6, 598, 242/598.3, 598.5, 599.3
See application file for complete search history.

(56) References Cited

U.S. PATENT DOCUMENTS 2,640,657 A * 6/1953 Guyer ..... B65H 35/0026 242/588.4
3,158,303 A * 11/1964 Petitto ..... B65H 35/0026 225/66
3,520,409 A * 7/1970 Gibbs, Sr. ..... B65D 5/5021 242/598.5
3,547,327 A * 12/1970 Remo ..... H01B 13/344 225/80
3,672,550 A 6/1972 Greco
3,768,713 A * 10/1973 Lash ..... B65H 35/0026 225/34
4,527,722 A * 7/1985 Strachan ..... B65C 11/00 225/25
4,625,901 A * 12/1986 Adelizi ..... B65H 35/0026 225/37
7,178,707 B1 * 2/2007 Bokina ..... B65H 35/0006 225/41

(Continued)

FOREIGN PATENT DOCUMENTS

DE 202010009066 U1 * 9/2010 ..... B65H 35/0073
JP 2023111025 A * 8/2023 ..... B65H 35/0026
KR 101605812 B1 * 3/2016 ..... B65H 35/002

*Primary Examiner* — Anna M Momper
*Assistant Examiner* — Ermia E. Melika
(74) *Attorney, Agent, or Firm* — Donald J. Ersler

(57) ABSTRACT

A multi-position tape dispenser preferably includes a base member, an axle support member and a plurality of tape axles. The base member includes a front member and a rear support member. The front member is attached to a front of the rear support member. The axle support member includes a plurality of tape spaces and a plurality of axle retention slots. Ends of the axle support member are preferably attached to left and right walls of the rear support member. Each tape axle includes an axle support portion, a left retention tab and a right retention tab. The left and right retention tabs of the tape axle are inserted into the two axle retention slots. In a first embodiment, two axle support members are retained in the base member. In a second embodiment one axle support member is retained in the base member.

16 Claims, 8 Drawing Sheets

(56) References Cited

U.S. PATENT DOCUMENTS

| | | | | |
|---|---|---|---|---|
| 2010/0252600 | A1* | 10/2010 | Chang | B65H 35/0073 225/77 |
| 2010/0314486 | A1* | 12/2010 | Wightman | B65H 35/0073 242/598.6 |
| 2012/0006932 | A1* | 1/2012 | Chang | B65H 35/0026 242/598 |
| 2016/0090264 | A1* | 3/2016 | Yu Chen | B65H 35/004 225/34 |
| 2019/0016552 | A1* | 1/2019 | Malmloff | B65H 35/0026 |

* cited by examiner

MULTI-POSITION TAPE DISPENSER

BACKGROUND OF THE INVENTION

1. Field of the Invention

The present invention relates generally to adhesive tape and more specifically to a multi-position tape dispenser, which includes at least one removable locking axle for retaining at least one roll of tape.

2. Discussion of the Prior Art

U.S. Pat. No. 3,672,550 to Grecco discloses a multi-tape dispenser. However, Grecco does not include a locking axle for preventing upward movement of the tape roll during dispensing.

Accordingly, there is clearly felt need in the art for a multi-position tape dispenser for retaining at least one roll of tape, and preventing upward movement of the at least one roll of tape during dispensing.

SUMMARY OF THE INVENTION

The present invention provides a multi-position tape dispenser for retaining at least one roll of tape during dispensing. The multi-position tape dispenser (tape dispenser) preferably includes a base member, an axle support member and a plurality of tape axles. The base member includes a front member and a rear support member. The front member includes a front base portion, an upper flange, a left front flange and a right front flange. The upper flange extends outward from a top of the front base portion. The left front flange extends backwards from a left edge of the front base portion. The right front flange extends backwards from a right edge of the front base portion. A serrated edge is preferably formed on a front edge of the upper flange. The rear support member includes a rear base member, a left side base member and a right-side base member. The left side base member extends forward from a left edge of the rear support member. The right-side base member extends forward from a right edge of the rear support member. A rear base flange extends forward from a bottom edge of the rear base member. A left base flange extends inward from a bottom edge of the left side base member. A right base flange extends inward from a bottom edge of the right-side base member. In a first embodiment, the left and right-side base members include a lower axle support portion and an upper axle support portion. In a second embodiment the left and right-side base members only include a first axle support portion.

The axle support member preferably includes a bottom axle support, a plurality of angled axle support members, a plurality of top axle retention members and a rear axle support. The bottom axle support preferably includes a bottom axle flange extending forward from a bottom edge thereof. The plurality of angled axle support members extend upward from a top edge of the bottom axle support. A tape space is formed between adjacent angled axle support members. A top of the plurality of angled axle support members are preferably terminated with a plurality of front axle support members. The plurality of top axle retention members extend backward from a top of the plurality of front axle support members. A pair axle retention slots are formed adjacent a front of each one of the plurality of top axle retention members. A rear of the plurality top axle retention members are terminated the rear axle support. A rear axle support flange preferably extends downward from a rear edge of the rear axle support. Outermost top axle retention members preferably include a downward extending top fastening flange.

Each tape axle preferably includes an axle support portion, a left retention tab and a right retention tab. The axle support portion preferably has a curved shape to receive an inner ring of a roll of tape. A left edge of the axle support portion is terminated with the left retention tab and a right edge of the axle support portion is terminated with the right retention tab. An end portion of the left and right retention tabs are sized to be removably received and retained by two axle retention slots in adjacent top axle retention members. The tape dispenser is preferably assembled in the following manner. In a first embodiment of the tape dispenser, the front member is attached to a front of the rear support member with welding or any other suitable method, such as adhesive. A first axle support member is preferably attached to the lower axle support portion of the left and right-side base members. A second axle support member is attached to the upper support portion of the left and right-side base members. In a second embodiment of the tape dispenser, the first axle support member is preferably attached to left and right-side base members. One of the plurality of tape axles is inserted through at least one roll of tape. The left and right retention tabs of the tape axle are inserted into two retention slots. When a roll of tape is pulled, the retention tabs pivot counterclockwise and lock the retention tabs in the two retention slots.

Accordingly, it is an object of the present invention to provide a tape dispenser for retaining at least one roll of tape, and preventing movement of the at least one roll of tape during dispensing.

These and additional objects, advantages, features and benefits of the present invention will become apparent from the following specification.

DETAILED DESCRIPTION OF THE PREFERRED EMBODIMENTS

Figure 1:
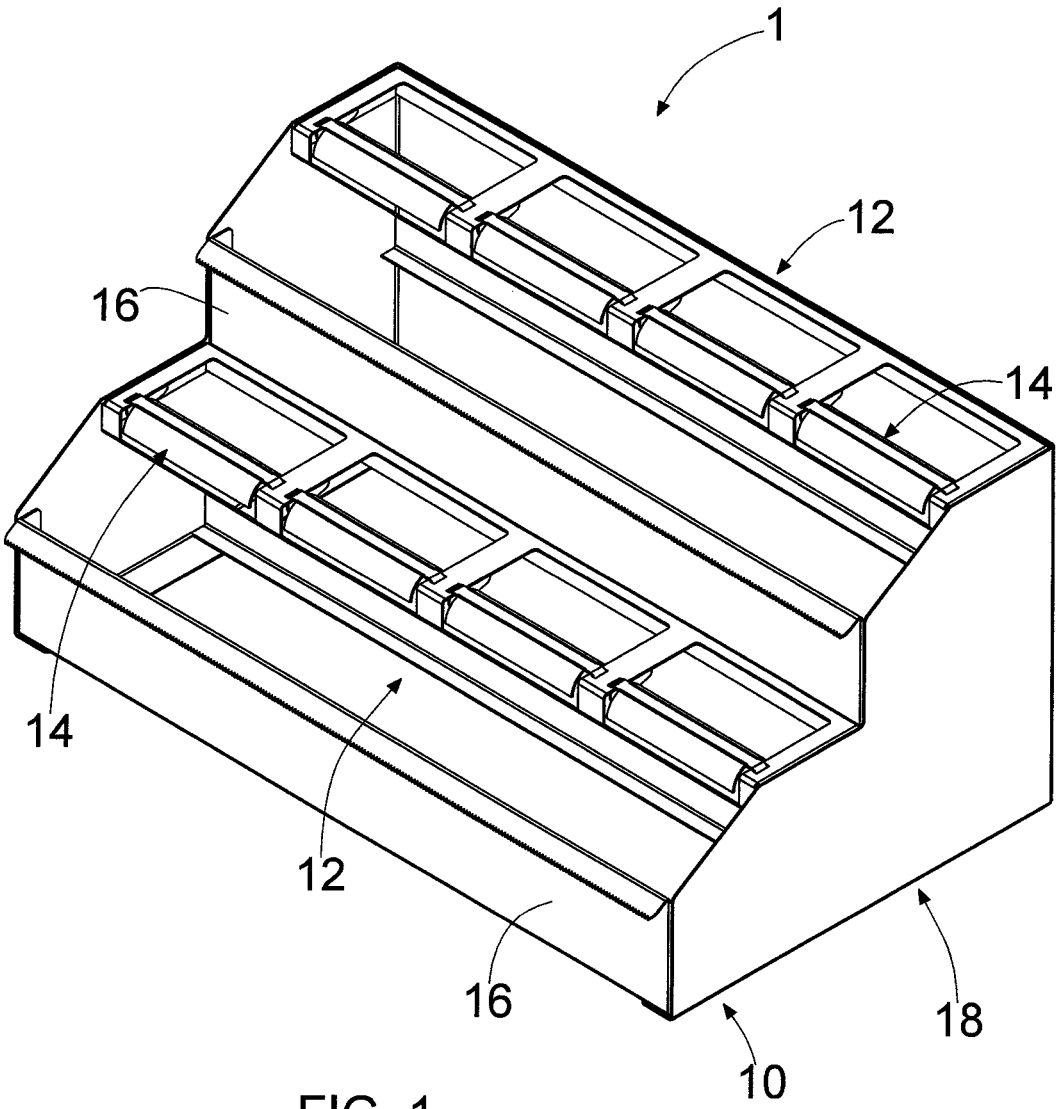
FIG. 1 is a perspective view of a tape dispenser in accordance with the present invention.
Figure 3:
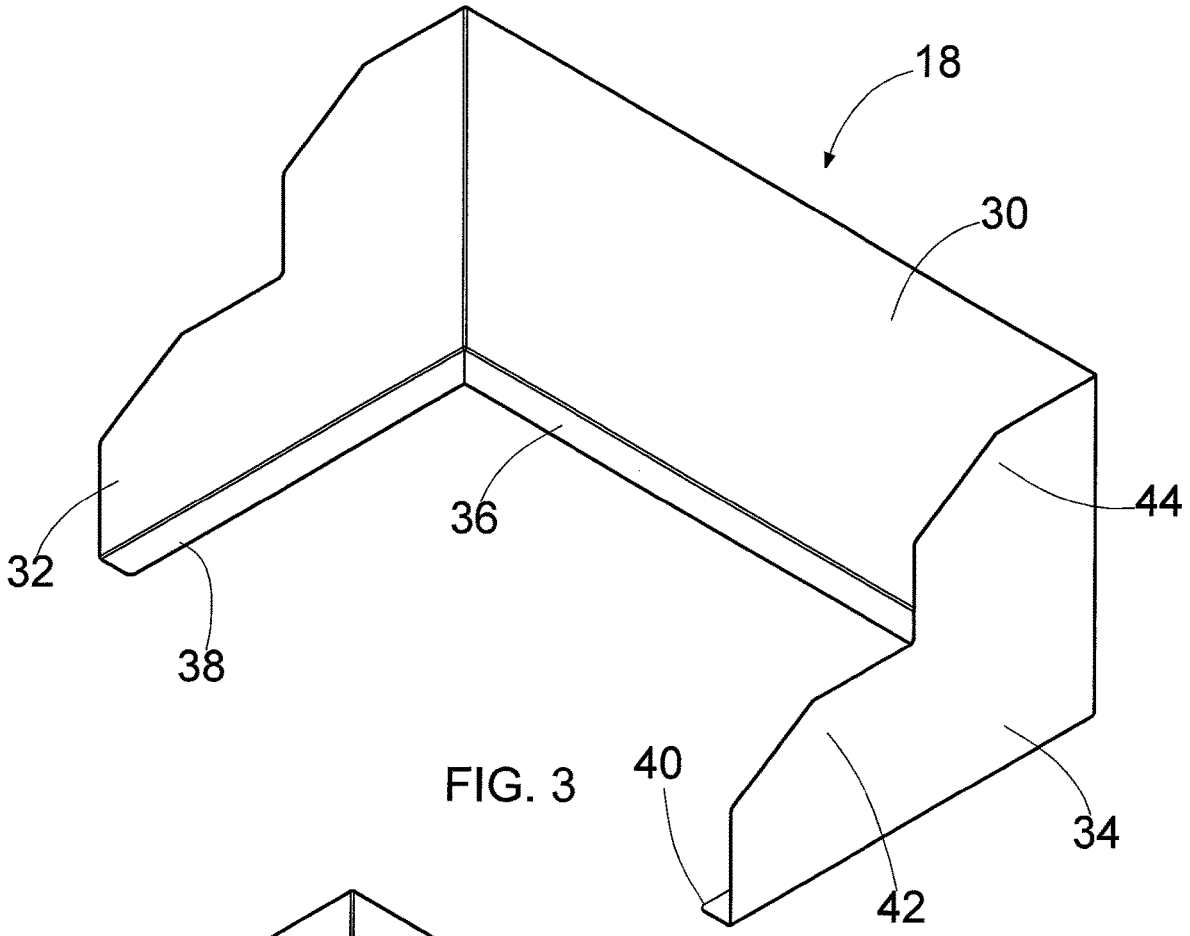
FIG. 3 is a perspective view of a rear support member of a base member of a tape dispenser in accordance with the present invention.
Figure 5:
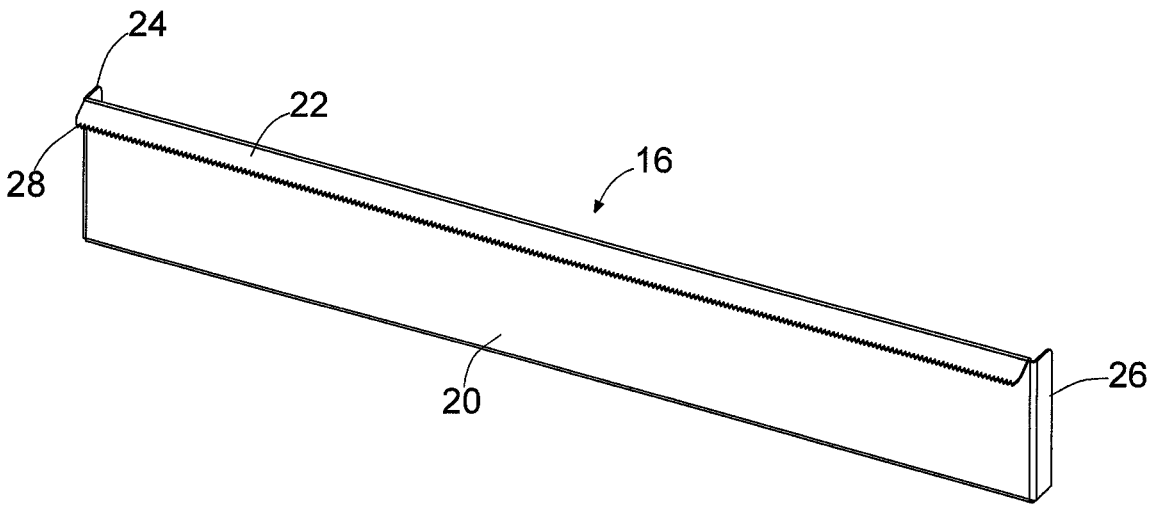
FIG. 5 is a perspective view of a front member of a base member of a tape dispenser in accordance with the present invention.

With reference now to the drawings, and particularly to FIG. 1, there is shown a front view of a tape dispenser 1. The tape dispenser 1 preferably includes a base member 10, two axle support members 12 and a plurality of tape axles 14. With reference to FIGS. 3 and 5 the base member 10 includes a front member 16 and a rear support member 18. The front member 16 includes a front base portion 20, an upper flange 22, a left front flange 24 and a right front flange 26. The upper flange 22 extends outward from a top of the front base portion 20. The left front flange 24 extends backwards from a left edge of the front base portion 20. The right front flange 26 extends backwards from a right edge of the front base portion 20. A serrated edge 28 is preferably formed on a front edge of the upper flange 22.

With reference to FIG. 3, the rear support member 18 includes a rear base member 30, a left side base member 32 and a right-side base member 34. The left side base member 32 extends forward from a left edge of the rear support member 30. The right-side base member 34 extends forward from a right edge of the rear support member 30. A rear base flange 36 extends forward from a bottom edge of the rear base member 30. A left base flange 38 extends inward from a bottom edge of the left side base member 32. A right base flange 40 extends inward from a bottom edge of the right-side base member 34. The left and right-side base members 32, 34 include a lower axle support portion 42 and an upper axle support portion 44.

Figure 2:
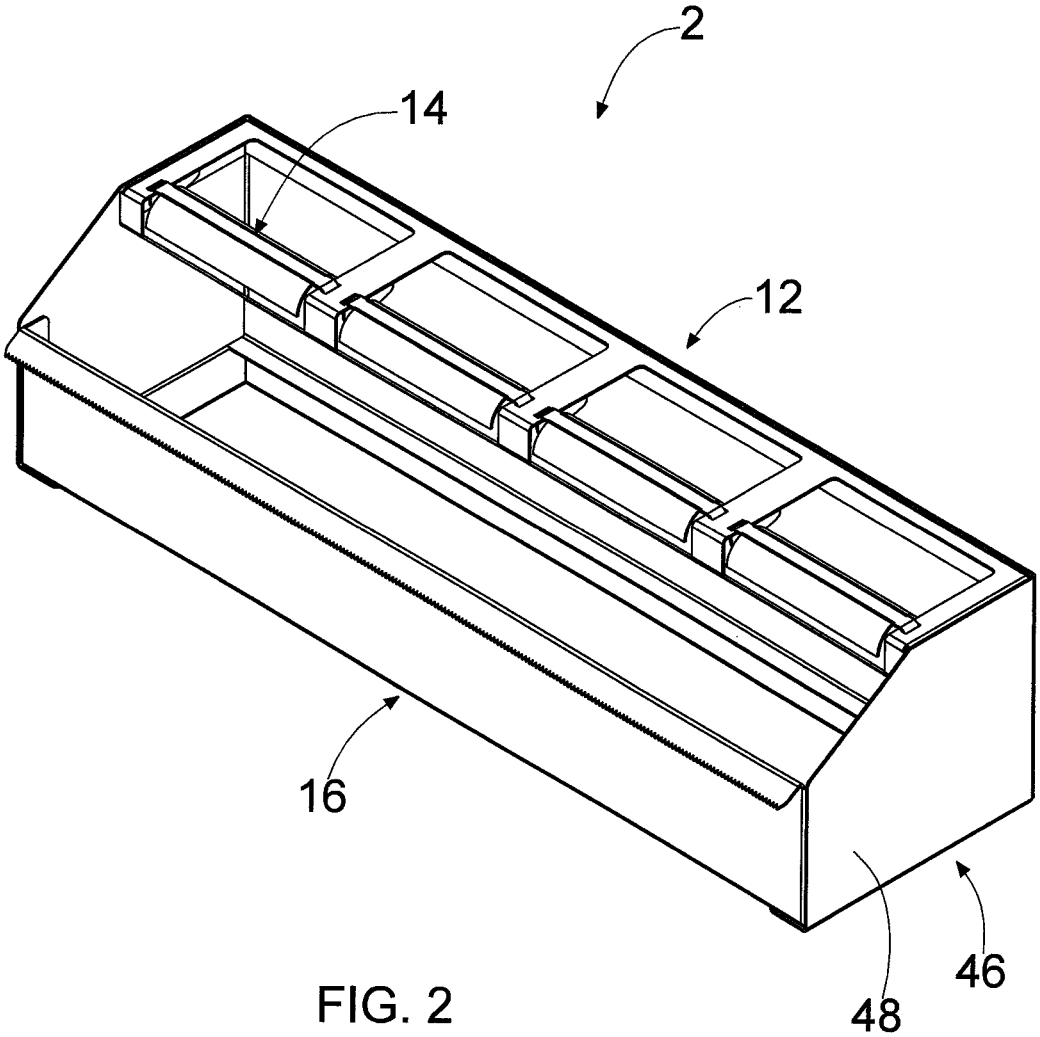
FIG. 2 is a perspective view of a second embodiment of a tape dispenser in accordance with the present invention.
Figure 4:
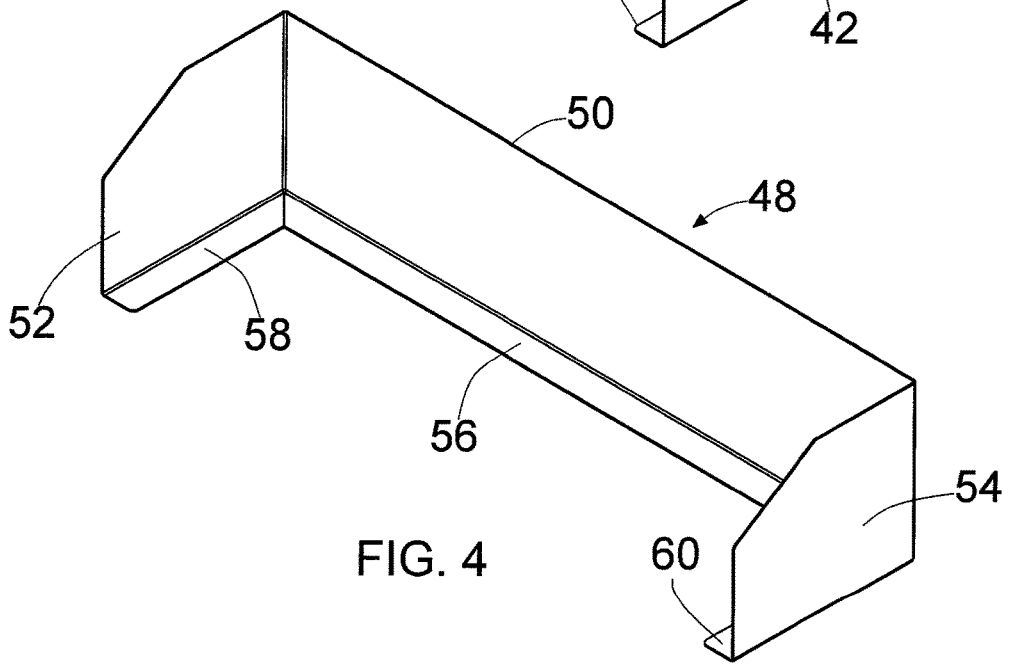
FIG. 4 is a perspective view of a rear support member of a base member of a second embodiment of a tape dispenser in accordance with the present invention.

With reference to FIGS. 2 and 4, a second embodiment of the tape dispenser 2 preferably includes a base member 46, a single axle support member 12 and the plurality of tape axles 14. The base member 46 preferably includes the front member 16 and a rear support member 48. The rear support member 48 includes a rear base member 50, a left side base member 52 and a right-side base member 54. The left side base member 52 extends forward from a left edge of the rear support member 50. The right-side base member 54 extends forward from a right edge of the rear support member 50. A rear base flange 56 extends forward from a bottom edge of the rear base member 50. A left base flange 58 extends inward from a bottom edge of the left side base member 52. A right base flange 60 extends inward from a bottom edge of the right-side base member 54.

Figure 2A:
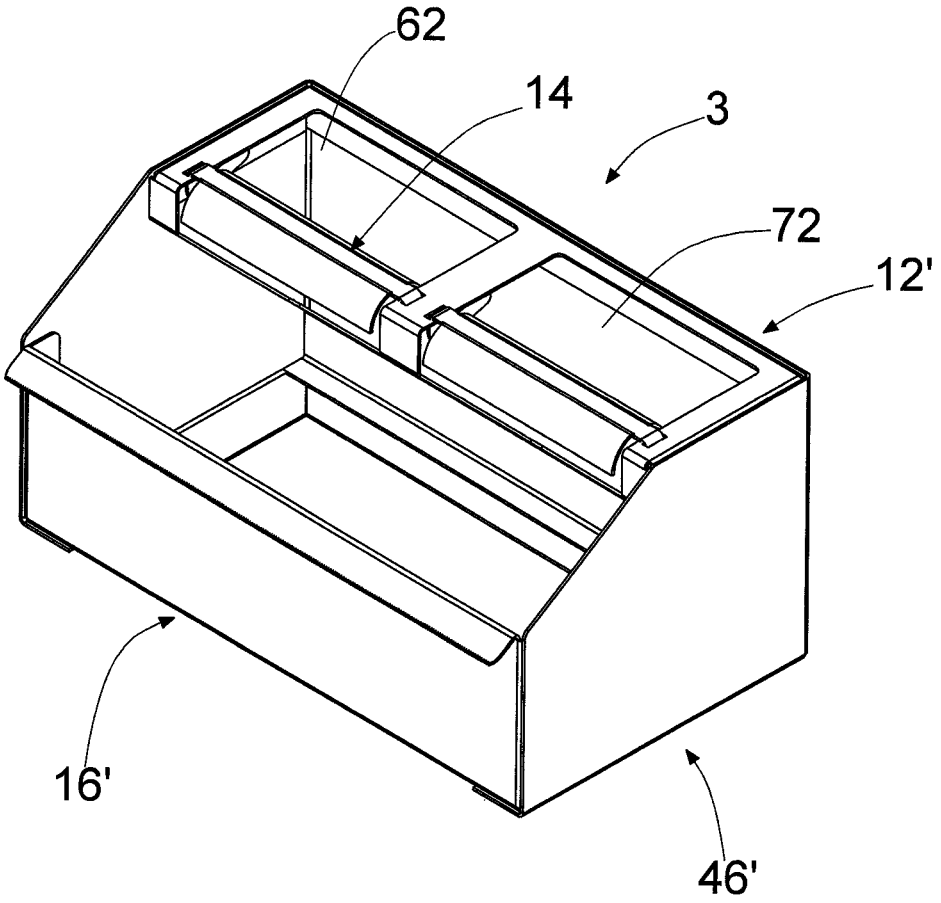
FIG. 2*a* is a perspective view of a second embodiment of a tape dispenser with two tape axles in accordance with the present invention.

With reference to FIG. 2*a*, a third embodiment of the tape dispenser 3 includes a base member 46', an axle support member 12' and two tape axles 14. The axle support member 12' only includes two tape spaces 72 instead of the four tape spaces 72 of the axle support member 12. The width of the base 46' member is shortened to accommodate the reduced width of the axle support member 12'. However, the axle support member 46 may have any suitable number of tape spaces 72.

Figure 6:
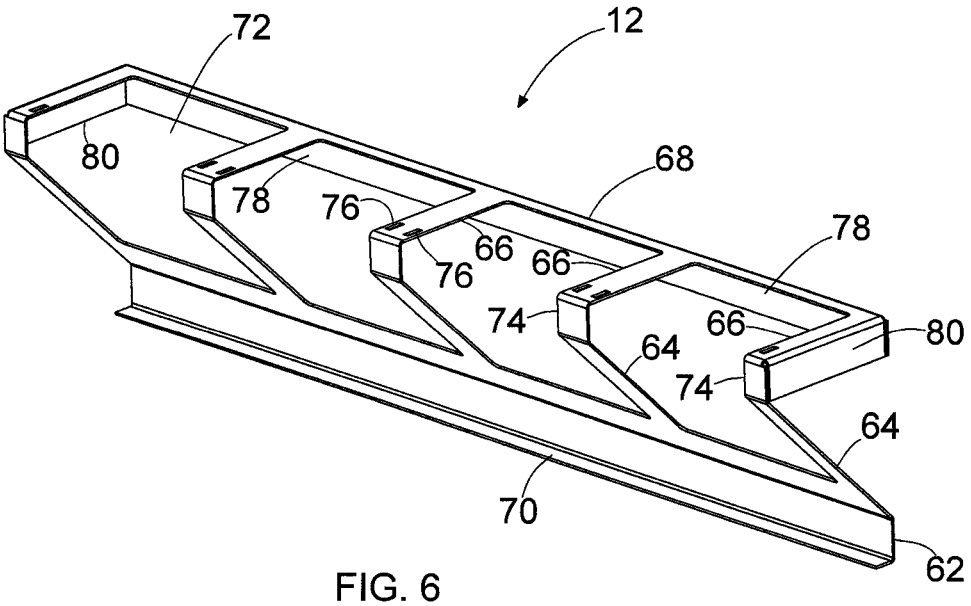
FIG. 6 is a perspective view of an axle support member of a tape dispenser in accordance with the present invention.

With reference to FIG. 6, the axle support member 12 preferably includes a bottom axle support 62, a plurality of angled axle support members 64, a plurality of top axle retention members 66 and a rear axle support 68. The bottom axle support 62 preferably includes a bottom axle flange 70 extending forward from a bottom edge thereof. The plurality of angled axle support members 64 extend upward from a top edge of the bottom axle support 62. The tape space 72 is formed between adjacent angled axle support members 64. A top of the plurality of angled axle support members 64 are preferably terminated with a plurality of front axle support members 74. The plurality of top axle retention members 66 extend backward from a top of the plurality of front axle support members 74. A pair of axle retention slots 76 are formed adjacent in a front of each one of the plurality of top axle retention members 66. A rear of the plurality top axle retention members 66 are terminated the rear axle support 68. A rear axle support flange 78 preferably extends downward from a rear edge of the rear axle support 68. Outermost top axle retention members 66 preferably include a downward extending top fastening flange 80.

Figure 7:
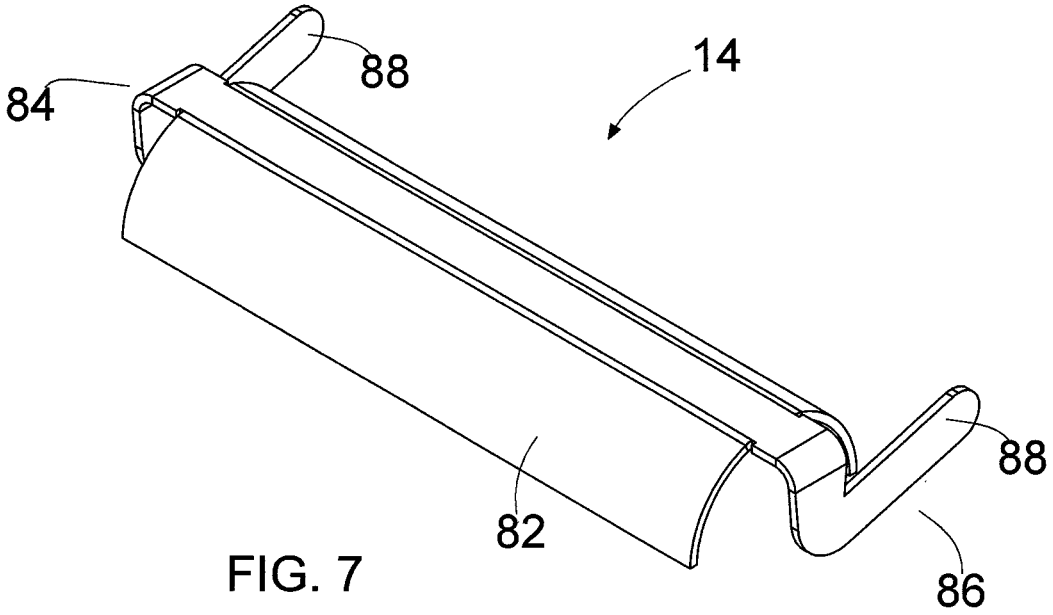
FIG. 7 is a perspective view of a tape axle of a tape dispenser in accordance with the present invention.
Figure 8A:
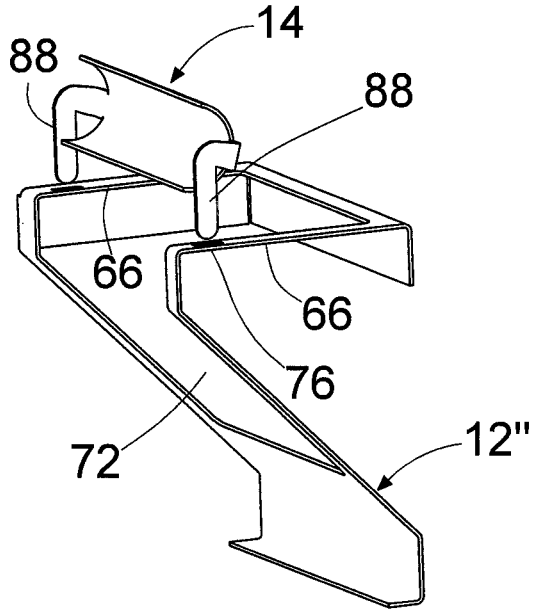
FIG. 8*a* is an exploded perspective view of a tape axle, before insertion into an axle support member with a single tape space of a tape dispenser in accordance with the present invention.
Figure 8B:
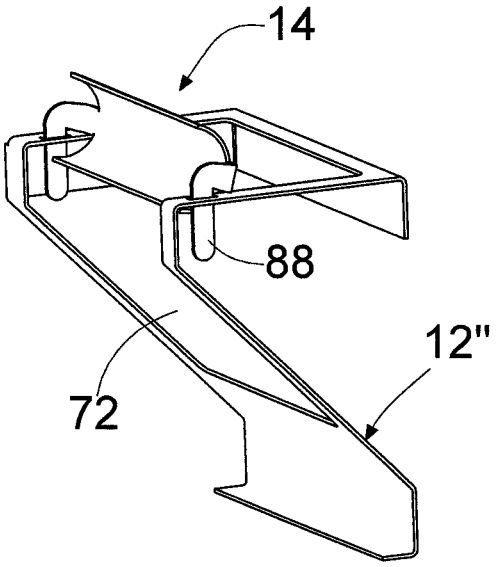
FIG. 8*b* is a perspective view of a tape axle inserted into an axle support member with a single tape space of a tape dispenser in accordance with the present invention.
Figure 8C:
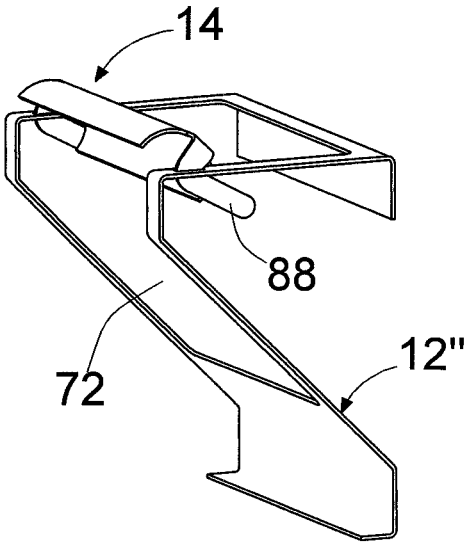
FIG. 8*c* is a perspective view of a tape axle inserted and partially rotated into an axle support member with a single tape space of a tape dispenser in accordance with the present invention.
Figure 8D:
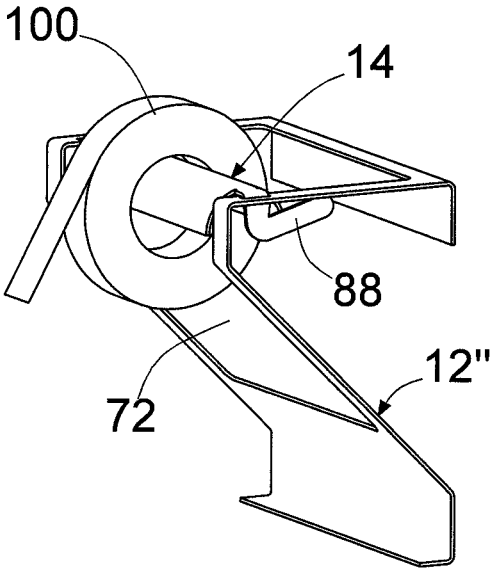
FIG. 8*d* is a perspective view of a tape axle inserted and retained in an axle support member with a single tape space and a roll of tape a tape dispenser in accordance with the present invention.

With reference to FIG. 7, each tape axle preferably includes an axle support portion 82, a left retention tab 84 and a right retention tab 86. The axle support portion 82 preferably has a curved shape to receive an inner ring of a roll of tape. A left edge of the axle support portion 82 is terminated with the left retention tab 84 and a right edge of the axle support portion 82 is terminated with the right retention tab 86. An end portion 88 of the left and right retention tabs 84, 86 are sized to be removably received and retained by two axle retention slots 76 in adjacent top axle retention members 66. With reference to FIGS. 8*a*-8*d*, the insertion and retention of a tape axle 14 in an axle support member 12" is shown. FIG. 8*a* shows the tape axle 14 before insertion into an axle support member 12". FIG. 8*b* shows the tape axle 14 inserted into the axle support member 12". FIG. 8*c* shows the tape axle 14 inserted and partially rotated into the axle support member 12". FIG. 8*d* shows the tape axle 14 inserted and retained in the axle support member 12". Unreeling a roll of tape 100 retained on the tape axle 14 causes the tape reel 14 to pivot counter clockwise in the axle support member 12".

The tape dispenser 1 is preferably assembled in the following manner. The left and right front flanges 24, 26 of the front member 18 are attached to the left and right base members 32, 34, respectively with welding or any other suitable method, such as adhesive. Each end of the bottom axle flange 70 of the axle support member 12 is preferably welded to the left and right base flanges 38, 40 of the rear support member 18. The top fastening flange 80 is preferably welded to the left and right side base members 32, 34 of the rear support member 18. The tape axle 14 is inserted through at least one roll of tape 100. The left and right retention tabs 84, 86 of the tape axle 14 are inserted into two retention slots 76. When a roll of tape 100 is pulled, the retention tabs pivot counterclockwise and are locked in the two retention slots 76.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed:

1. A tape dispenser, comprising:

a base member includes a rear support member;

at least one axle support member, each one of said at least one axle support member includes at least two top axle retention members, a rear axle support and a bottom axle support, a rear of said at least two top axle retention members extend from a front of said rear axle support, a tape space formed between two of said at least two top axle retention members, a front of said at least two top axle retention members are supported by said bottom axle support, said rear axle support and said bottom axle support are attached to said rear support member; and at least one tape axle having opposing ends, which are retained in two of said at least two top axle retention members.

2. A tape dispenser, comprising:

a base member includes at least one front member and a rear support member, said at least one front member extends from a front of said rear member;

at least one axle support member, each one of said at least one axle support member includes at least two top axle retention members, a rear axle support and a bottom axle support, a rear of said at least two top axle retention members extend from a front of said rear axle support, a tape space formed between two of said at least two top axle retention members, a front of said at least two top axle retention members are supported by said bottom axle support, said rear axle support and said bottom axle support are attached to said rear support member; and at least one tape axle having opposing ends, which are retained in two of said at least two top axle retention members.

3. The tape dispenser of claim 2, wherein:

said base member includes at least one serrated edge, each one of said at least one serrated edge is formed in front of one of said at least one axle support member.

4. A tape dispenser, comprising:

a base member includes at least one front member and a rear support member, a serrated edge is formed on a top of said front member, said at least one front member extends from a front of said rear member;

at least one axle support member, each one of said at least one axle support member includes at least two top axle retention members, a rear axle support and a bottom axle support, a rear of said at least two top axle retention members extend from a front of said rear axle support, a tape space formed between two of said at least two top axle retention members, a front of said at least two top axle retention members are supported by said bottom axle support, said rear axle support and said bottom axle support are attached to said rear support member; and at least one tape axle having opposing ends, which are retained in two of said at least two top axle retention members.

5. The tape dispenser of claim 4, wherein:

said at least one front member includes a front base portion, an upper flange, a left front flange and a right front flange, said upper flange extends outward from a top of said front base portion, a serrated edge is formed on a front edge of said upper flange.

6. The tape dispenser of claim 4, wherein:

said rear support member includes said rear base member, a left side base member and a right-side base member, said left side base member extends forward from a left edge of said rear support member, said right-side base member extends forward from a right edge of said rear support member, said left side base member and said right-side base member have a vertical orientation.

7. The tape dispenser of claim 1, wherein:

said base member includes at least one serrated edge, each one of said at least one serrated edge is formed in front of one of said at least one axle support member.

8. The tape dispenser of claim 1, wherein:

each one of said at least one tape axle includes an axle support portion having a curved cross section, a left retention tab and a right retention tab, said left retention tab is retained on a left end of said axle support portion, said right retention tab is retained on a right end of said axle support, wherein said left and right retention tabs are rotated 90 degrees, after insertion into said at least two top axle retention members.

9. The tape dispenser of claim 2, wherein:

each one of said at least one tape axle includes an axle support portion having a curved cross section, a left retention tab and a right retention tab, said left retention tab is retained on a left end of said axle support portion, said right retention tab is retained on a right end of said axle support, wherein said left and right retention tabs are rotated 90 degrees, after insertion into said at least two top axle retention members.

10. The tape dispenser of claim 4, wherein:

each one of said at least one tape axle includes an axle support portion having a curved cross section, a left retention tab and a right retention tab, said left retention tab is retained on a left end of said axle support portion, said right retention tab is retained on a right end of said axle support, wherein said left and right retention tabs are rotated 90 degrees, after insertion into said at least two top axle retention members.

11. The tape dispenser of claim 1, wherein:

said bottom axle support is located below said rear axle support.

12. The tape dispenser of claim 2, wherein:

said bottom axle support is located below said rear axle support.

13. The tape dispenser of claim 4, wherein:

said bottom axle support is located below said rear axle support.

14. The tape dispenser of claim 1, wherein:

each one of said at least one axle support member is formed from a single piece of material.

15. The tape dispenser of claim 2, wherein:

each one of said at least one axle support member is formed from a single piece of material.

16. The tape dispenser of claim 4, wherein:

each one of said at least one axle support member is formed from a single piece of material.

* * * * *